US008113255B2

(12) United States Patent
Massotte et al.

(10) Patent No.: US 8,113,255 B2
(45) Date of Patent: Feb. 14, 2012

(54) DEVICE FOR POSITIONING THE CONVEYOR BELT RUNNING THROUGH MACHINES FOR THERMAL TREATMENT OF FILAMENTS

(75) Inventors: Philippe Massotte, Gueberschwihr (FR); Michel Mazoyer, Pfastatt (FR); Serge Munschi, Rantzwiller (FR)

(73) Assignee: Superba, Mulhouse (FR)

( * ) Notice: Subject to any disclaimer, the term of this patent is extended or adjusted under 35 U.S.C. 154(b) by 1484 days.

(21) Appl. No.: 11/603,125

(22) Filed: Nov. 22, 2006

(65) Prior Publication Data

US 2007/0128567 A1 Jun. 7, 2007

(30) Foreign Application Priority Data

Dec. 2, 2005 (FR) ..... 05 53695

(51) Int. Cl.
*B32B 41/00* (2006.01)

(52) U.S. Cl. ..... 156/351; 156/361; 156/367; 156/368

(58) Field of Classification Search ..... 156/351, 156/361, 367, 368; 198/806, 807, 860.3, 198/861.1

See application file for complete search history.

(56) References Cited

U.S. PATENT DOCUMENTS

| | | | | |
|---|---|---|---|---|
| 4,949,558 | A | 8/1990 | Enderlin et al. | |
| 5,074,130 | A | 12/1991 | Enderlin et al. | |
| 2007/0044428 | A1 * | 3/2007 | Mazoyer et al. | 53/137.2 |

FOREIGN PATENT DOCUMENTS

| | | |
|---|---|---|
| GB | 2 410 233 | 7/2005 |
| JP | 59 163210 | 9/1984 |

* cited by examiner

*Primary Examiner* — George Koch
(74) *Attorney, Agent, or Firm* — Young & Thompson

(57) ABSTRACT

A device for positioning the conveyor belt running through machines for thermal treatment of filaments, essentially constituted by a pressurized chamber (1) traversed by a conveyor belt (2) enclosed at each end by a sealing head mounted on a frame or movable door (3) connected to the pressurized chamber (1) by a bellows (4), each sealing head including a head of horizontal superposed rollers (5, 6) which are pressed against the opposite surfaces of the conveyor belt (2). The device includes a positioning elements (8) and a position control elements (9) acting on a very short region immediately adjacent each sealing head. The invention is more particularly applicable in the field of the textile industry, in particular of the field of treating filaments by elements of thermal treatment machines currently called heat setting machines.

20 Claims, 4 Drawing Sheets

DEVICE FOR POSITIONING THE CONVEYOR BELT RUNNING THROUGH MACHINES FOR THERMAL TREATMENT OF FILAMENTS

The present invention relates to the field of the textile industry, in particular the treatment of filaments by means of thermal treatment machines presently called heat setting machines, and has for its object a device for positioning the conveyor belt that runs through such machines.

Thermal treatment machines are essentially constituted by a pressurized thermal treatment chamber for textile filaments disposed on a conveyor belt passing through said chamber, which is closed at its two ends by sealing heads each comprising a frame or movable door fixed to the pressurized chamber, a pair of horizontal superposed rollers which are pressed against opposite surfaces of the conveyor belt, and sealing means to form a sealed closure between the rollers and the frame.

The horizontal rollers are actuated by gripping means permitting movement of at least one of the rollers in one direction or the other, for gripping against the conveyor belt. Moreover, the sealing heads are mounted, each by means of its frame or movable door, in a pivotal manner relative to a medial vertical axis and are connected to the treatment chamber by means of a bellows extending between the vertical pivotal axis and the frame or movable door of said sealing heads.

In the course of operation, the conveyor belt can be subjected to a deviation between the inlet and the outlet of the thermal treatment machine, which deviation has the risk of giving rise, in the case of exceeding a predetermined limit, to the risk catching within the interior of the machine, which could give rise at least to stopping the machine to take care of the problem, even to damage.

At present, this problem is solved by the provision of the positioning of the conveyor belt between the inlet and outlet heads by means of cells for detecting the position of said belt at the ends of the machine, which is to say near the sealing heads, these detection cells delivering a control signal for modification of the position of the heads by means of actuators acting on the frame or movable door of these latter to cause their pivoting. Such pivoting of the sealing heads has the effect of modifying the position of the axis of the sealing rollers, such that the conveyor belt is corrected in the opposite direction from the deviation in question, this because of the gripping of the conveyor belt between the superposed horizontal rollers. Thus, during pivoting of the sealing head, the conveyor belt is driven pivotally, because of its gripping between the longitudinal rollers, along a transverse generatrix, which causes corresponding correction of this latter, so as to correct its deviation and to return it to its normal surface position.

Generally, the means for detection and correction of the position of the conveyor belt of such machines are quite suitable to ensure good positioning of said conveyor belt. However, there arises the problem of detection and hence of correction of the deviation when the conveyor belt, because of its aging, becomes incurved. Indeed, the position detectors for the conveyor belt at the inlet and outlet of the machine are sensitive to the deformation of this conveyor belt.

Moreover, because of the mounting of the frames or movable doors of the sealing heads, each on a vertical pivotal axle provided remote from said frames or movable doors of the sealing heads, it is necessary to take account in an anticipated manner, of the pivoting of said sealing heads, which is increased by the effect of a lever arm effect due to the distance between the pivotal axis and the plane of the horizontal superposed rollers and the distance between the detectors and the heads, giving rise to amplification of the deviation in question.

Moreover, the mounting of the sealing heads in the manner described above gives rise to an important overhang of the heads and hence of the corresponding stresses on the pivotal axis, requiring corresponding dimensioning of the assembly of the mounting elements of said heads.

The present invention has for its object to overcome these drawbacks by proposing a positioning device for the conveyor belt running through thermal treatment machines for filaments, permitting controlling and correcting continuously the deviation of said conveyor belt, whilst limiting the amplitude of the movements of the sealing heads.

To this end, the positioning device for the conveyor belt according to the invention, adapted to equip thermal treatment machines of filaments, essentially constituted by a pressurized chamber traversed by the conveyor belt and closed at each end by a sealing head mounted on a frame or movable door connected to the pressurized chamber by means of a bellows, each sealing head comprising a pair of horizontal superposed rollers which are pressed against opposite surface of the conveyor belt, is characterized in that it comprises a positioning means and a means for controlling the position acting on a very short region immediately adjacent each sealing head.

The invention will be better understood from the following description, which relates to preferred embodiments, given by way of non-limiting examples, and explained with reference to the accompanying schematic drawings, in which.

Figure 4:
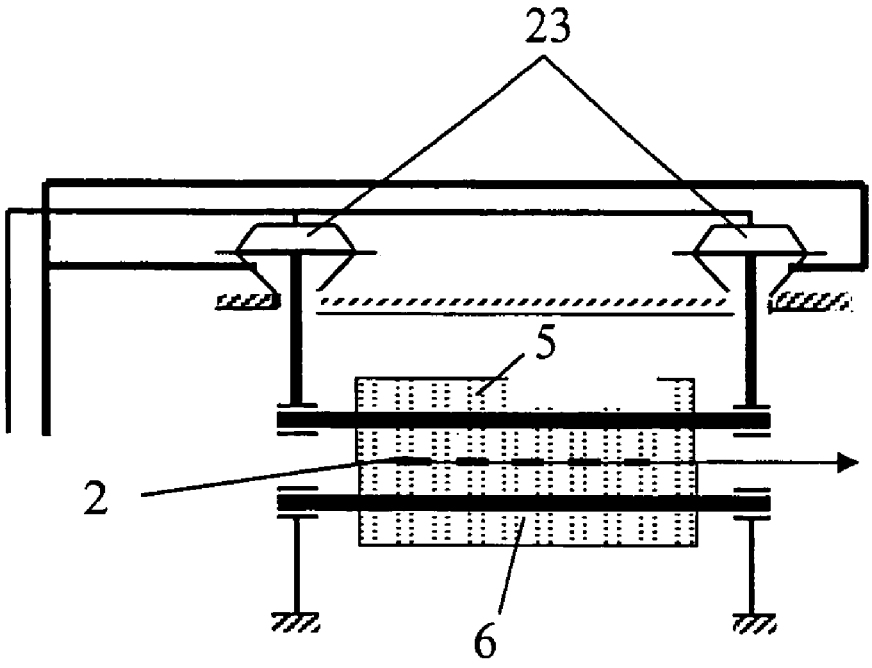
Figure 5:
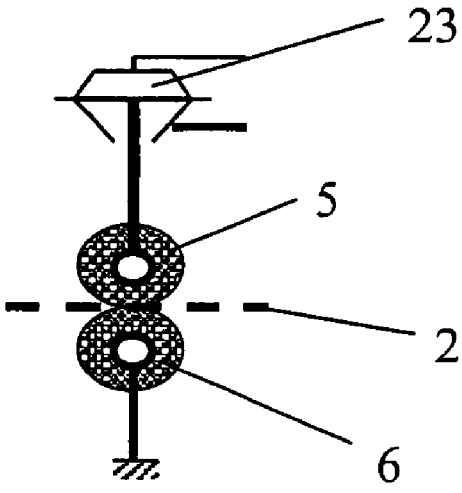
Figure 6:
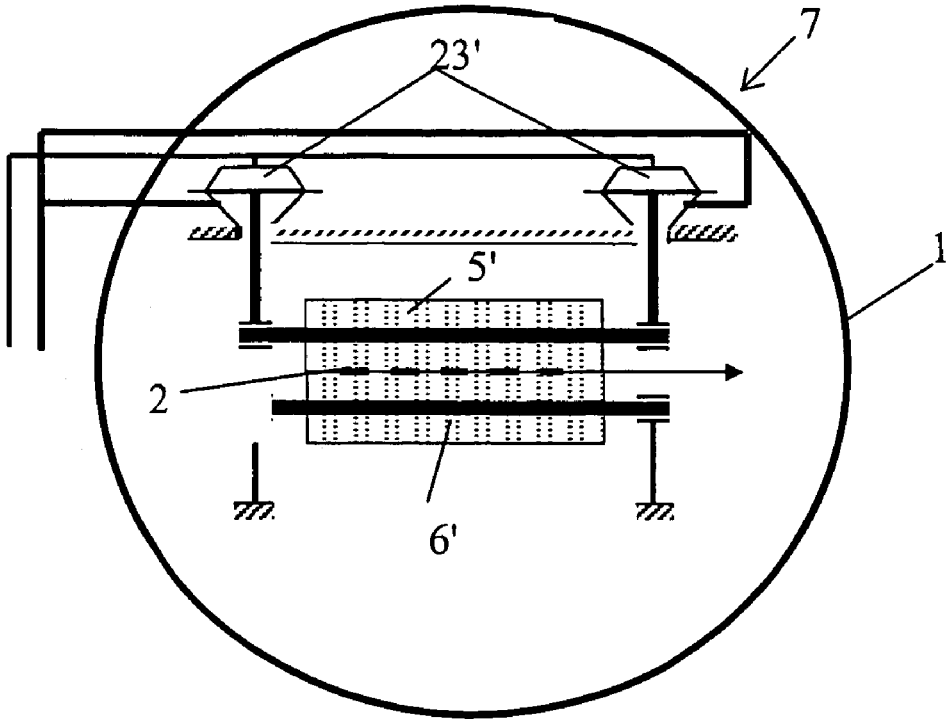
Figure 7:
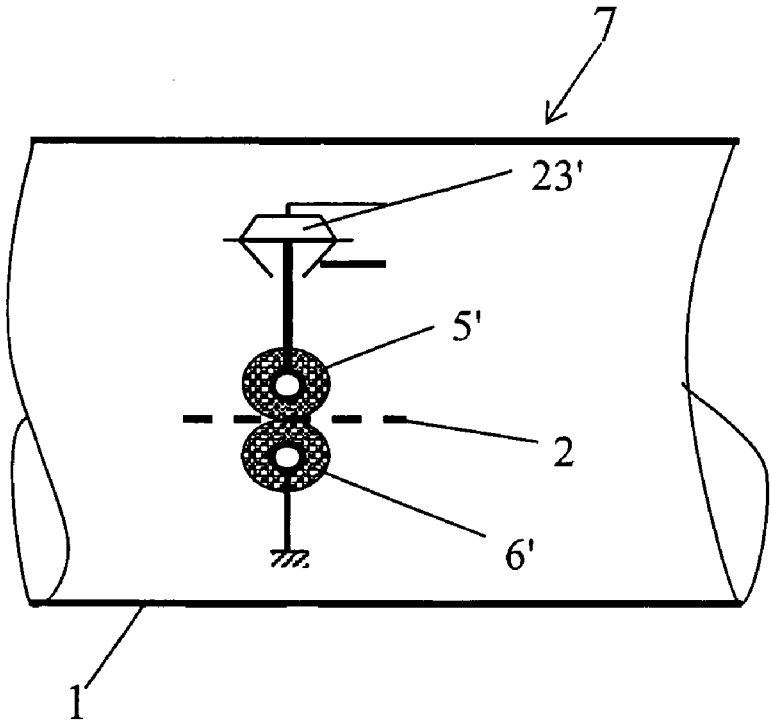

FIGS. 4 and 5 are cross-sectional views, respectively in front elevation and in side elevation, of another modified embodiment of the invention, and FIGS. 6 and 7 are views analogous to those of FIGS. 4 and 5, of another modified embodiment of the invention.

Figure 1:
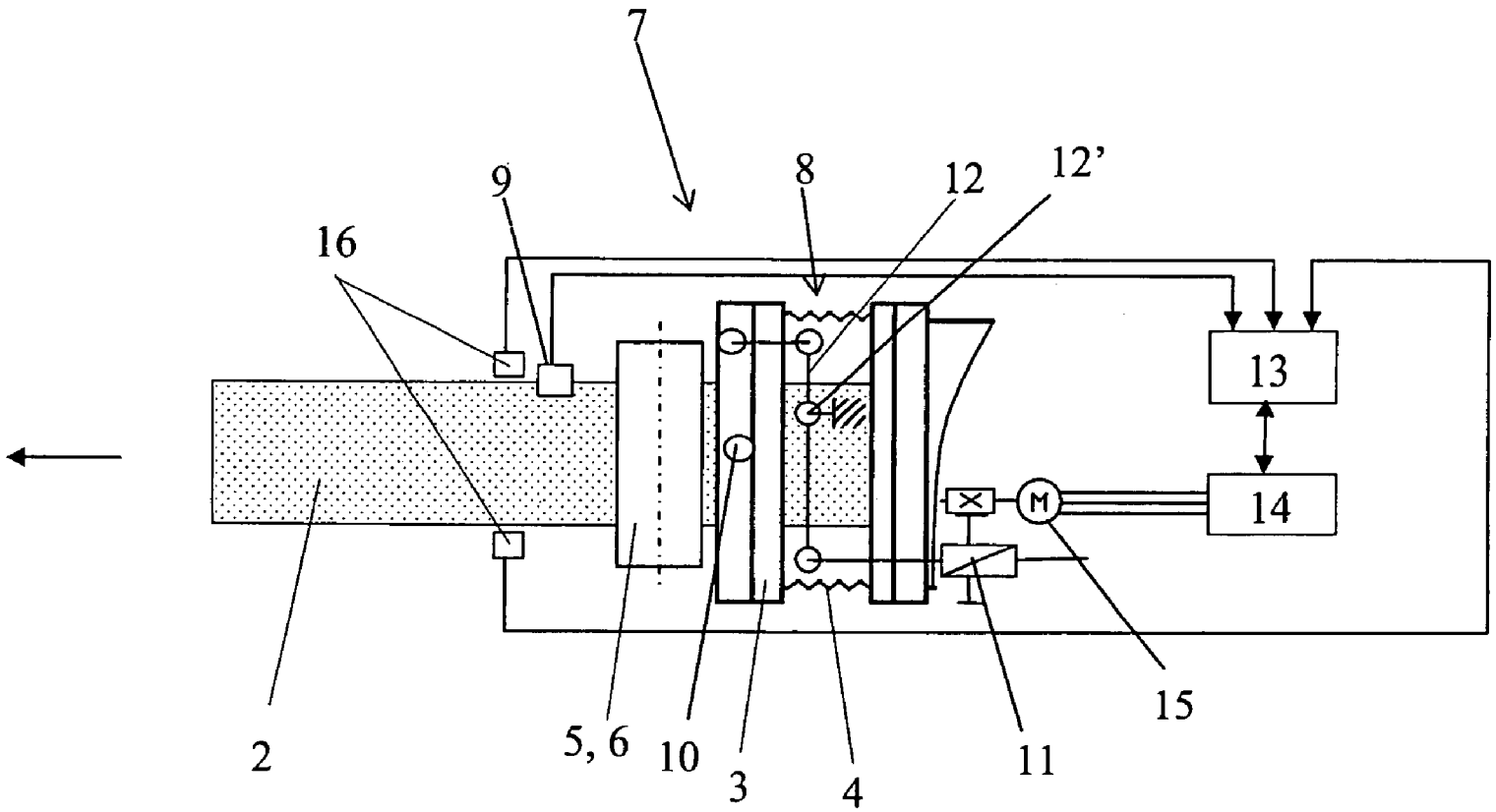
FIG. 1 is a fragmentary plan and cross-sectional view of a thermal treatment machine for filaments equipped with the device according to the invention.
Figure 2:
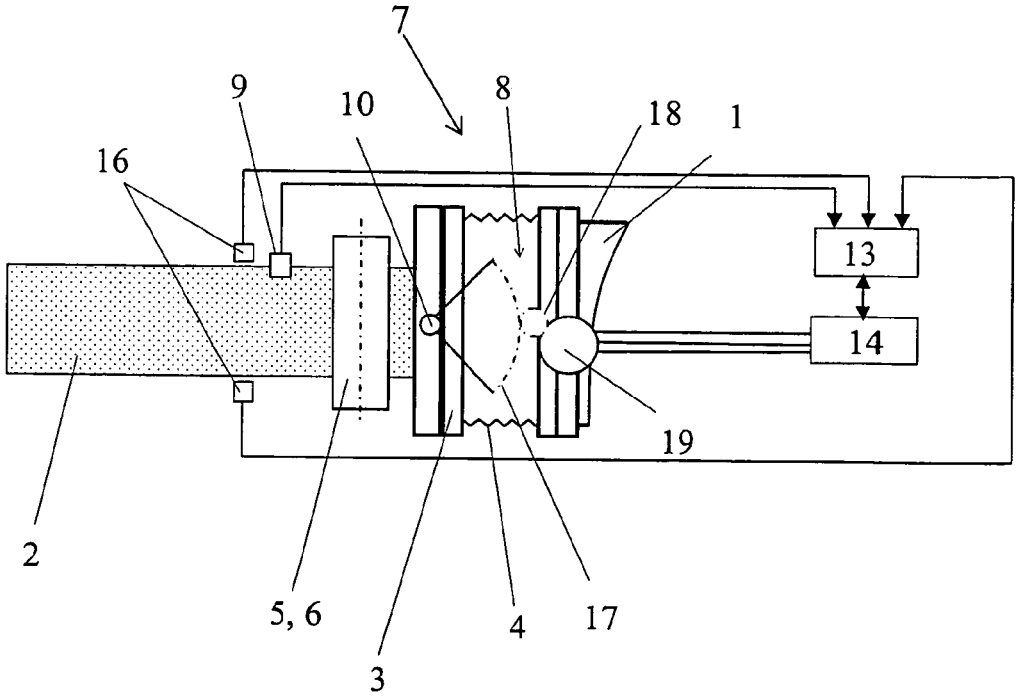
FIGS. 2 and 3 are views analogous to that of FIG. 1 of modified embodiments of the invention.
Figure 3:
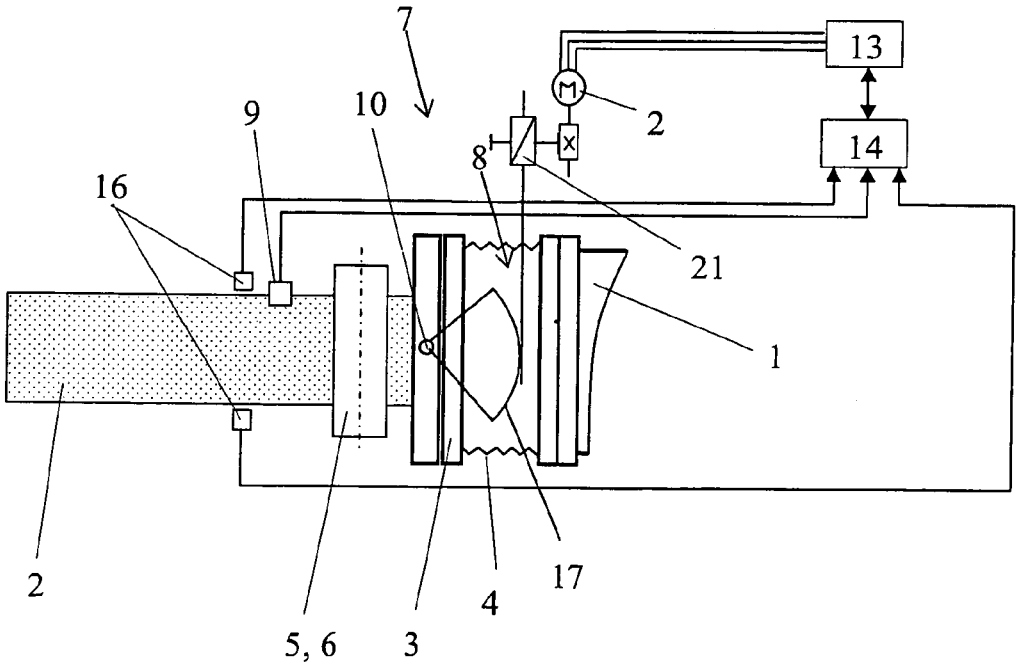

FIG. 1 of the accompanying drawings shows, by way of example, a machine for the thermal treatment of filaments, essentially constituted by a pressurized chamber 1 traversed by a conveyor belt 2 and closed at each end by a sealing head mounted on a frame or movable door 3 connected to the pressurized chamber 1 by means of a bellows 4, each sealing head comprising a pair of horizontal superposed rollers 5, 6 which are pressed against opposite surfaces of the conveyor belt 2. So as to avoid inadmissible deviation of the conveyor belt, this thermal treatment machine for filaments is provided with a positioning device 7 for this belt. In FIGS. 1 to 3 of the accompanying drawings, only one end of a thermal treatment machine for filaments is shown in cross-sectional and plan view, such that only one roller of the pair of rollers 5 and 6 forming the sealing head is visible. Moreover, it is clear that the end (not shown) of the thermal treatment machine for filaments is present in a symmetrical manner to that shown on said accompanying drawings.

According to the invention, and as shown by way of example in FIGS. 1 to 3 of the accompanying drawings, the positioning device 7 comprises a positioning means 8 and a position control means 9 acting on a very short region immediately adjacent each sealing head.

The positioning means 8 consists, according to the preferred embodiment of FIG. 1, in a pivotal axle 10 for the frame or movable door 3 directly secured with said frame or movable door 3, and an actuator 11 for pivoting of the frame or movable door 3 by means of links 12 mounted on the edge of the frame or movable door 3 and said actuator 11. This latter is preferably constituted in the form of a screw jack.

Thus, it is possible to carry out pivoting of very small amplitude of the frame or movable door 3, such that sealing head constituted by the rollers 5 and 6 is pivoted about its pivotal axle 10 and gives rise to movement of the conveyor belt 2 in a direction opposite the deviation in question.

The position control means 9 is constituted by at least one position detector disposed adjacent at least one edge of the conveyor belt 2, adjacent the superposed horizontal rollers 5 and 6 of the sealing head, this detector being a proportional analog detector connected to a computer control means 13 delivering a correction signal to a servo-inverter 14 for controlling a motor 15 for driving the actuator 11 constituting the positioning means 8 for the frame or movable door 3.

Preferably, the detector forming the position control means 9 is an optical detector extending on both sides of an edge of the conveyor belt 2. However, it is also possible to provide the detector forming the position control means 9 in the form of a pneumatic detector, an eddy current detector of a feeler. The operation of such detectors is known to those skilled in the art and will not be described in detail.

Moreover, the position control means 9 can be completed by a safety device consisting in detection cells 16 extending laterally on opposite sides of the conveyor belt 2 upstream or downstream of the detector forming the position control means 9, these detection cells 16 being adapted to be of the same type as this latter.

According to another characteristic of the invention, the computer means 13 for the positioning means 8 and for the position control means 9 of the sealing heads of the two ends of the machine for the thermal treatment of filaments, are preferably interconnected and the positioning means 8 for the frame or movable door 3 are disposed in an inverse manner so as to carry out movement in the identical direction for the two sealing heads. Thus, upon detection of a deviation of the conveyor belt at one or the other end of the machine for the thermal treatment of filaments, it is necessary to correct said conveyor belt 2 so as to center it perfectly within the machine for the treatment of filaments and the correction of deviation necessary at one end must automatically be carried back to the other end, at least as to its direction.

In the operation of the thermal treatment machine, the belt 2 passes in the longitudinal direction of the treatment line, passing through said machine and, when the belt deviates from its path to the left or to the right, its deviation is measured adjacent the sealing head by the position control means 9, which transmits the relevant data to the computing means 13. When a deflection greater than a maximum permissible value is detected, the computing means 13 determines a deviation correction to be carried out and delivers a corresponding control signal to the servo-inverter 14 for controlling the motor 15 for actuating the screw jack 11. This latter thus drives the links 12 with a pivotal movement about an axle 12' having the effect of giving rise to corresponding pivoting of the frame or movable door 3 about the axle 10 and thus a corresponding angular movement of the sealing head. It follows that the rollers 5, 6 of this latter, which grip between them the conveyor belt 2, shifting of said conveyor belt 2 corresponding to the pivotal direction of the sealing head and of the frame or movable door 3. The conveyor belt 2 is thus returned to a normal direction of movement within the permitted tolerances.

According to a modified embodiment of the invention, shown in FIG. 2 of the accompanying drawings, the actuator for pivoting the frame or movable door 3 can also act directly on said frame or movable door 3 and is constituted for this purpose by a toothed sector 17 secured at one end to said frame or movable door 3 and by a pinion 18 engaging with said toothed sector 17 and driven by a stepping motor 19 controlled by means of the servo-inverter 14. In such a case, the elements for transmission of the pivotal movement of the frame or movable door 3 are limited to a minimum, which has the result of reducing the risk of mechanical accident, as well as maintenance work.

It is also possible, according to another modified embodiment of the invention, shown in FIG. 3 of the accompanying drawings, to constitute the pivotal actuator of the frame or movable door 3 in the form of a toothed sector 17 secured at one end to said frame or movable door 3 and by a rack 20 engaging with said toothed sector 17 and driven by a screw jack 21, whose motor 22 is controlled by means of a servo-inverter 14. This embodiment permits obtaining results and advantages comparable to those obtained by means of the device according to FIG. 2.

According to another modified embodiment of the invention, and as shown in FIGS. 4 and 5 of the accompanying drawings, the positioning means 8 can be formed directly by the horizontal roller 5, 6 of the sealing heads, by means of one of these rollers being able to apply different pressure at its ends to the conveyor belt 2, for example individual control of actuators 23 for applying pressure to the ends of these rollers. Thus, it is possible, by a separate and controlled command of the application pressure of the rollers 5, 6 against the conveyor belt 2, to carry out a greater pressure at one end of the rollers, for example on the left side (FIGS. 4 and 5), which has the effect of urging the corresponding edge of the conveyor belt 2 toward the end of the rollers subjected to lesser pressure, namely to the right, as shown by the arrow (FIG. 4), such that the detected deviation can be rapidly and easily corrected.

It is also possible, according to another modified embodiment of the invention, shown in FIGS. 6 and 7 of the accompanying drawings, to make the positioning device 7 in the form of an assembly comprising a single positioning means disposed within the chamber 1 of the machine for thermal processing of filaments, and position control means 9 acting immediately adjacent each sealing head. In such a case, the single positioning means can be in the form of two rollers 5', 6', disposed within the processing chamber 1, substantially at the middle of this latter, and gripped on opposite sides against the conveyor belt 2, in the manner of the horizontal rollers 5 and 6 of the sealing heads, the gripping of the ends of these rollers 5', 6' in the direction of the conveyor belt 2 being carried out independently and in a controlled manner by means of actuating jacks 23'. In such an embodiment, which corresponds in its construction to that described above with respect to the sealing heads according to FIGS. 4 and 5, the correction of the conveyor belt 2 by shifting can also be carried out by application of a greater driving pressure against one edge of the conveyor belt, such that the latter is automatically corrected in the opposite direction. Thus, the increase of the pressure of the rollers on one edge of the conveyor belt gives rise to an increased driving effect of said edge or an effect of relative sliding of the other edge, such that the conveyor belt 2 has the natural tendency to undergo modification of its alignment.

An embodiment of a thermal treating machine for filaments according to the two latter modes of embodiment set forth, permits modifying considerably the construction even of the machine for thermal treatment, because of the fact that the frame or movable door 3 can be replaced by a fixed device for closing the ends of the treatment chamber, of simpler construction and requiring no bellows at the junction with said chamber.

Thanks to the invention, it is possible to control perfectly the deviation of a conveyor belt, whether the latter is entirely new and straight or used and having deformations such as a dip or undulations, by continuous correction of such diversion. This correction is preferably carried out by providing micro-pivotings of the frame or movable door 3, no matter what the speed of movement of the belt and if desired also when this latter is subjected to reverse movements of relatively short length.

This limitation of the deviations is essentially due to the limitation, even the suppression of the lever arm effect of the mounting of the frame or movable door 3. Moreover, this simplified mounting of this frame or movable door 3 has the advantage of a simpler construction of the machine.

The invention thus permits perfectly positioning, over a predetermined portion of its length, a conveyor belt 2 of great length, continuously moving in a plane. Thus, the correction of the deviation of the conveyor belt 2 is carried out without changing the direction of the belt outside the plane by return roller means or the like, as is conventional, for example for the guidance of moving bands.

Of course, the invention is not limited to the embodiment described and shown in the accompanying drawings. Modifications remain possible, particularly as to the construction of the various elements or by substitution of technical equivalents, without thereby departing from the scope of protection of the invention.

The invention claimed is:

1. A device for positioning the conveyor belt moving in thermal treatment machines for filaments, comprising:

a pressurized chamber (1) having a first end and a second end;

a conveyor belt (2) traversing said pressurized chamber (1);

first and second bellows (4) connected to the pressurized chamber (1) respectively at the first and second ends of the pressurized chamber (1);

a first movable unit comprised of one of a movable door (3) and a movable frame, the first movable unit connected to the first end of the pressurized chamber by said first bellows (4), through which first movable unit the conveyor belt circulates;

a first sealing head mounted on the first movable unit and closing the first end of the pressurized chamber;

a second movable unit comprised of another one of a movable door (3) and a movable frame, the second movable unit connected to the second end of the pressurized chamber by said second bellows (4), through which second movable unit the conveyor belt also circulates;

a second sealing head mounted on the first movable unit and closing the second end of the pressurized chamber, each said sealing head comprising a pair of superposed horizontal rollers (5, 6) pressed against opposite surfaces of the conveyor belt (2);

a positioning means (8) arranged to change a position of the movable unit; and position control means (9) acting on a region immediately adjacent each sealing head to detect a position of the conveyor belt at the region.

2. The device according to claim 1, wherein the positioning means (8) comprises i) a pivotal axle (10) for the movable unit, the axle (10) secured directly to said movable unit, and ii) an actuator (11) for pivoting the movable unit about said axle (10).

3. The device according to claim 2, wherein the actuator (11) acts on the movable unit by means of links (12) mounted between an edge of the movable unit and said actuator (11).

4. The device according to claim 2, wherein the actuator (11) is constituted by a screw jack.

5. The device according to claim 1, wherein the position control means (9) is constituted by a position detector disposed adjacent at least one edge of the conveyor belt (2), and adjacent the superposed horizontal rollers (5, 6) of the sealing head, the detector being a proportional analog detector connected to computer means (13) comprising a correction signal to a servo-inverter (14) for controlling a drive motor (15) of the actuator (11) constituting positioning means (8) of the movable unit.

6. The device according to claim 5, wherein the detector forming the position control means (9) is an optical detector extending on opposite sides of an edge of the conveyor belt (2).

7. The device according to claim 5, wherein the detector forming the position control means (9) is in the form of a pneumatic detector, an eddy current detector, or a feeler.

8. The device according to claim 5, wherein the position control means (9) is completed by a safety device comprising detection cells (16) extending laterally on opposite sides of the conveyor belt (2) upstream or downstream of the detector forming the positioning control means (9), these detection cells (16) being of the same type as the detector forming the positioning control means (9).

9. The device according to claim 5, wherein the computing means (13) of the positioning means (8) and position control means (9) of the sealing heads, are interconnected and the positioning means (8) of the movable unit are disposed in reverse manner so as to provide movement in an identical direction of the two sealing heads.

10. The device according to claim 2, wherein the actuator for pivoting the movable unit acts directly on the movable unit and is constituted by a toothed sector (17) secured at one end to the movable unit and by a pinion (18) engaging with said toothed sector (17) and driven by a stepping motor (19) controlled by means of a servo-inverter (14).

11. The device according to claim 2, wherein the actuator for pivoting of the movable unit acts directly on the movable unit and is constituted by a toothed sector (17) secured at one end to the movable unit and by a rack (20) engaging with said toothed sector (17) and driven by a screw jack (21), whose motor (22) is controlled by servo-inverter means (14).

12. The device according to claim 1, wherein the positioning movement (8) of each sealing head is effected directly by the horizontal rollers (5, 6) of said sealing head, at least one of these rollers being adaptive at its ends with different pressure application to the conveyor belt (2), under the control of individual actuators (23) for pressing the ends of these rollers.

13. The device according to claim 1, wherein the positioning device (7) is in the form of an assembly comprising a single positioning means disposed within the pressurized chamber (1) of the thermal processing machine for filaments, and position control means (9) disposed immediately adjacent each sealing head.

14. The device according to claim 13, wherein the single positioning means (7) is in the form of two rollers (5', 6') disposed within the pressurized chamber (1), substantially in the middle of the pressurized chamber, and gripped on opposite sides against the conveyor belt (2), in the manner of horizontal rollers (5 and 6) of the sealing heads, the gripping of the ends of these rollers (5', 6') in the direction of the conveyor belt (2) being carried out independently of the manner of control of the actuating means (23').

15. A device for positioning the conveyor belt moving in thermal treatment machines for filaments, comprising:

a pressurized chamber (1) having a first end and a second end;

a conveyor belt (2) traversing said pressurized chamber (1);

first and second bellows (4) connected to the pressurized chamber (1) respectively at the first and second ends of the pressurized chamber (1);

one of a movable door (3) and a movable frame, connected respectively to each of the first and second ends end of the pressurized chamber by said first and second bellows (4), through which ones of the movable door (3) and the movable frame the conveyor belt circulates;

at the first and second ends of the pressurized chamber, sealing heads mounted on each of the respective ones of the movable door (3) and the movable frame, the sealing heads closing the first and second ends of the pressurized chamber;

each said sealing head comprising a pair of superposed horizontal rollers (5, 6) pressed against opposite surfaces of the conveyor belt (2);

a positioning means (8) arranged to change a position of the respective one of the movable door (3) and the movable frame; and position control means (9) acting on a region immediately adjacent each sealing head to detect a position of the conveyor belt at the region.

16. The device according to claim 15, wherein the positioning means (8) comprises:

i) a pivotal axle (10) for said respective one of the movable door (3) and the movable frame, the axle (10) secured directly to said respective one of the movable door (3) and the movable frame, and ii) an actuator (11) for pivoting said respective one of the movable door (3) and the movable frame about said axle (10).

17. The device according to claim 16, wherein the actuator (11) acts on the respective one of the movable door (3) and the movable frame via links (12) mounted between an edge of the respective one of the movable door (3) and the movable frame and said actuator (11).

18. The device according to claim 15, wherein, the position control means (9) comprises a position detector disposed adjacent at least one edge of the conveyor belt (2), and adjacent the superposed horizontal rollers (5, 6) of the sealing head, and the detector is a proportional analog detector connected to computer means (13) comprising a correction signal to a servo-inverter (14) for controlling a drive motor (15) of the actuator (11) constituting positioning means (8) of the respective one of the movable door (3) and the movable frame.

19. The device according to claim 18, wherein the detector forming the position control means (9) is an optical detector extending on opposite sides of an edge of the conveyor belt (2).

20. The device according to claim 16, wherein, the actuator acts directly on the respective one of the movable door (3) and the movable frame, and the actuator comprises i) a toothed sector (17) secured at one end to the respective one of the movable door (3) and the movable frame and ii) a pinion (18) engaging with said toothed sector (17) and driven by a stepping motor (19) controlled by a servo-inverter (14).

* * * * *